United States Patent [19]

Kinoshita et al.

[11] Patent Number: 4,474,197

[45] Date of Patent: Oct. 2, 1984

[54] COIN TRANSFER APPARATUS

[75] Inventors: Yoshio Kinoshita; Katsuhiko Sakamoto, both of Himeji, Japan

[73] Assignee: Glory Kogyo Kabushiki Kaisha, Japan

[21] Appl. No.: 444,917

[22] Filed: Nov. 29, 1982

[30] Foreign Application Priority Data

Nov. 30, 1981 [JP] Japan ..... 56-190564
Jul. 15, 1982 [JP] Japan ..... 57-122014

[51] Int. Cl.[3] ..... G07D 9/04
[52] U.S. Cl. ..... 133/4 A; 221/160
[58] Field of Search ..... 133/3 A, 4 A, 1 A, 1 R; 221/160, 161, 162; 198/392, 443

[56] References Cited

U.S. PATENT DOCUMENTS 3,674,128 7/1972 Mead ..... 198/392

FOREIGN PATENT DOCUMENTS 52-695 4/1977 Japan ..... 133/3 A

*Primary Examiner*—Stanley H. Tollberg
*Attorney, Agent, or Firm*—Beveridge, De Grandi & Kline

[57] ABSTRACT

An improved apparatus for transferring coins to a coin counting system, a coin selecting system or the like by way of a coin passage under centrifugal force caused by rotation of a rotary disc is disclosed. The improvement consists in that the rotary disc includes a first surface portion constituting an inside part thereof from which coins are displaced onto the coin passage one after another with a single line of arrangement maintained, a circular boundary wall defining the outer periphery of the first surface portion and having a height appreciably less than the thickness of the smallest coins to be transferred and a second surface portion extending outward of the circular boundary wall in the radial direction. A coin guiding member is disposed so as to allow the coins on the second surface portion to be displaced back onto the first surface portion while the rotary disc rotates.

13 Claims, 15 Drawing Figures

COIN TRANSFER APPARATUS

BACKGROUND OF THE INVENTION

The present invention relates to a coin transfer or feeding apparatus and more particularly to an improved apparatus of the type for transferring coins to a coin counting process, a coin selecting process or the like by way of a coin passage under centrifugal force caused by rotation of a rotary disc.

A hitherto known coin transfer apparatus of the above rotary disc type essentially comprises a rotary disc, a coin passage extending from the periphery of the rotary disc and located flush with the upper surface of the rotary disc and a coin thickness limiting member disposed between the periphery of the rotary disc and the inlet part of the coin passage so as to prevent coins in piles from entering the coin passage. The coin thickness limiting member is mounted at an elevated position having a height appreciably more than the thickness of coins to be transferred so that just a single coin passes beneath the coin thickness limiting member toward the coin passage. Thus, it serves to prevent any two stacked coins from entering the coin passage. The coin passage is generally in operative connection with a coin counting passage or a coin selecting passage for selecting received coins in accordance with their kind so that a combination of the coin passage and the coin counting passage or the coin selecting passage serves as a coin counter or a coin selector.

In practice, coins to be handled have a different thickness. In an extreme case thicker coins have two or more times the thickness of thinner coins. The result is that the conventional coin transfer apparatus cannot transfer coins to the coin counting passage or the coin selecting passage correctly when there exists an extremely high difference in thickness among the coins. This is because that the height of the coin thickness limiting member measured from the rotary disc is dimensioned so as to allow the thickest coin to pass therethrough, causing two stacked thinner coins to pass or get jammed in the space defined between the coin thickness limiting member and the rotary disc. For the reason the conventional coin transfer apparatus of the above-described type is used only when coins having few difference in thickness are transferred to the coin counting passage or the coin selecting passage. This means that the scope of application is very limitative. Another drawback is that coin jamming tends to take place beneath the coin thickness limiting member when a deformed coin or the like is delivered thereto while it is mixed among other normal coins of a specific kind.

Due to the arrangement that the conventional rotary disc type coin transfer apparatus is equipped with the coin thickness limiting member, a trouble such as coin jamming or the like takes place unavoidably.

As is well known, the coin passage on the conventional coin transfer apparatus for conveying coins from the rotary disc is constructed by a combination of a coin guide piece of which inlet part is located along the periphery of the rotary disc and a coin introduction piece in operative connection with said coin guide piece. The width of the inlet part of the coin guide piece as well as the coin passage can be previously adjusted in dependence on the diameter of coins to be transferred prior to starting operation of the apparatus.

In a certain country, larger coins having a diameter two or more times larger than that of smaller coins are used. When coins having various diameters are transferred toward the coin passage while they are mixed at random, there is a tendency that two coins arranged in the transverse direction enter the coin passage via the inlet part thereof. This causes coin jamming to take place often at the inlet part of the coin passage.

Therefore, a coin counter, a coin selector or the like in operative connection with the rotary disc type coin transfer apparatus can be operated only when various kinds of coins having the substantially same thickness and diameter are transferred thereto while they are mixed at random.

SUMMARY OF THE INVENTION

It is an object of this invention to obviate the drawbacks inherent to the conventional coin transfer apparatus as described above.

More specifically, it is an object to provide a drastically improved coin transfer apparatus of the rotary disc type which ensures no transference of two stacked coins to a coin passage without necessity for any type of coin thickness limiting member which constitutes an essential component for the conventional coin transfer apparatus.

Another object of this invention is to provide a coin transfer apparatus in which each coin can be moved smoothly to the coin passage from the rotary disc without a coin jamming at the inlet part of the coin passage.

According to this invention, there is provided a coin transfer apparatus comprising: a rotary disc including a first surface portion defined within a circular area having a predetermined radius measured from the center of rotation thereof in which coins fed from the outside thereonto are adapted to move outward in the radial direction under centrifugal force caused by the rotation of the rotary disc, a circular boundary wall defining the outer periphery of said first surface portion, said circular boundary wall having a height less than the thickness of coins to be transferred, and a second surface portion extending outward of the circular boundary wall in the radial direction so as to carry the coins thereon; a coin passage adapted to receive the coins carried on the first surface portion and then convey them to the next process or the like while the coins are positionally defined by means of the circular boundary wall during the movement on the first surface portion; and a coin guiding member extending from the outer periphery of the rotary disc to the circular boundary wall or the position in the proximity of the latter so as to urge the coins displaced away from the first surface portion beyond the circular boundary wall onto the second surface portion to move back again onto the first surface portion.

According to this invention in another aspect thereof, there is provided a coin transfer apparatus in which a first surface portion is provided with at least one annular groove in the proximity of the outer periphery thereof, said coin passage having at least one coin passage member of which foremost end part is adapted to be fitted into the annular groove in the substantially tangential direction relative to the groove, said coin passage member extending from the first surface portion beyond the outer wall of the rotary disc in an upward inclination while at least one of the side faces of the coin passage on the inner side of the disc is open so that coins of various diameters can pass on the coin passage member, said coin passage also having a coin conveyance means disposed on the coin passage so as to convey the coins in cooperation with the coin passage member.

The nature, utility, and further features of this invention will be apparent from the following detailed description with respect to preferred embodiments of the invention when read in conjunction with the accompanying drawings briefly described below, throughout which like parts are designated by like reference numerals.

DETAILED DESCRIPTION OF THE INVENTION

Figure 1:
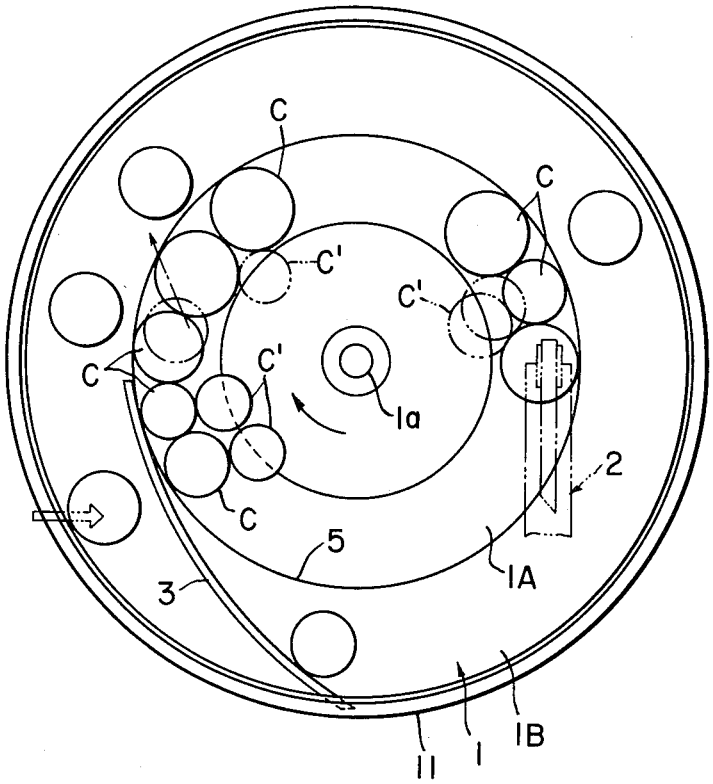
FIG. 1 is a schematic plan view of a coin transfer apparatus in accordance with the present invention, illustrating a principle of operation of the apparatus.
Figure 2:
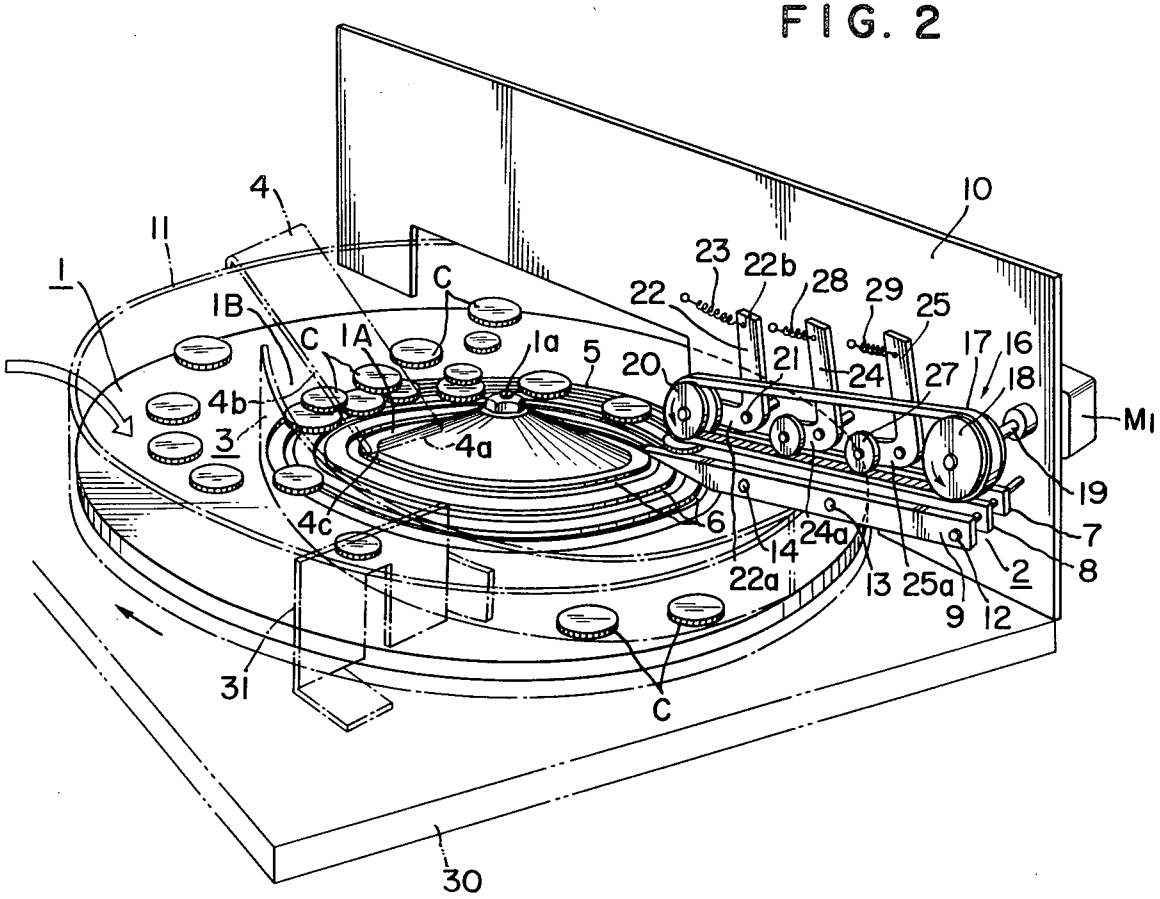
FIG. 2 is a perspective view of the coin transfer apparatus in accordance with an embodiment of the present invention.

Referring first to FIGS. 1 and 2, a coin transfer or feeding apparatus in accordance with an embodiment of the invention essentially comprises a rotary disc 1, a coin passage 2, a coin guiding member 3 and a coin turning means 4.

Specifically, the rotary disc 1 is fixedly mounted onto a center shaft 1*a* and includes a first lower surface portion 1A as defined within a circular area having a predetermined radius about said center shaft 1*a*, a second higher surface portion 1B located outward of the first surface portion 1A and a boundary wall 5 extending between the first and second surface portions 1A and 1B.

Figure 3:
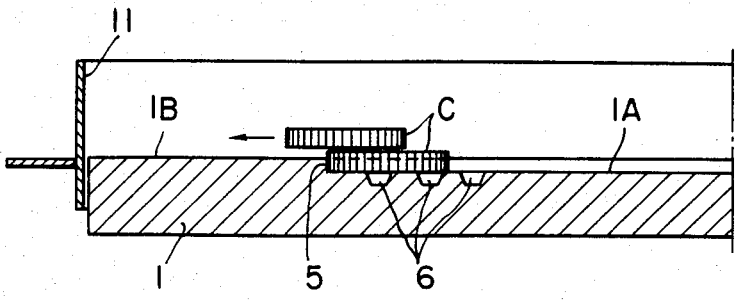
FIG. 3 is a partial sectional view of the rotary disc in the apparatus in FIG. 2, shown in an enlarged scale.

As is apparent from FIG. 3, the height of the boundary wall 5 is dimensioned appreciably less than the thickness of the coins to be transferred.

Figure 5:
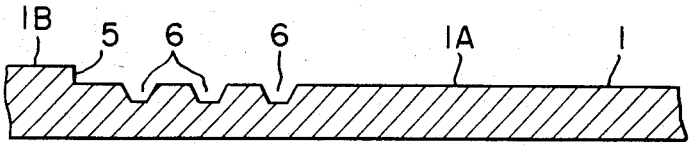
FIG. 5 is also a partial sectional view of the rotary disc in the apparatus, particularly illustrating a plurality of annular grooves formed thereon in an enlarged scale.

As illustrated in FIG. 5, the first surface portion 1A is formed with a plurality of annular grooves 6 (three lines of annular grooves 6 in the illustrated embodiment) each of which circulates about the center shaft 1*a* and has an inverted trapezoidal cross-sectional configuration.

The coin passage 2 essentially comprises a coin passage member constituting a coin passage surface and a coin conveyance means for conveying coins C. In the illustrated embodiment, the coin passage surface is constructed by a combination of three coin passage members 7, 8 and 9 in the form of an elongated plate which are arranged in parallel to one another. The coin passage members 7, 8 and 9 extend over a part of the rotary disc 1 in the tangential direction of the portion 1A and further project outward of an upright standing guide plate 11 in an upward inclination, and the guide plate 11 serves to prevent the coins C from being scattered away from the periphery of the second surface portion 1B of the rotary disc 1. They are fixedly secured to an upright standing plate 10 on a coin counting machine or the like by means of a plurality of holding rods (three holding rods 12, 13 and 14 in the illustrated embodiment).

Figure 4:
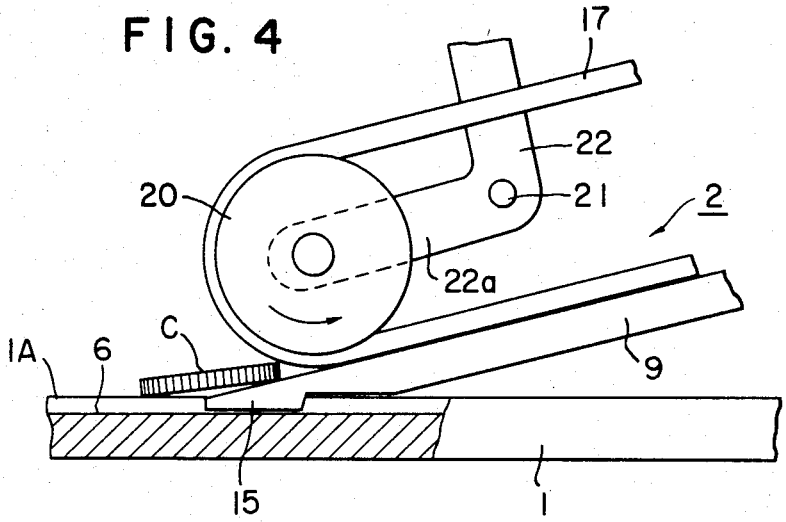
FIG. 4 is also a partial sectional view of the rotary disc in the apparatus in FIG. 2, particularly illustrating a cooperation with coin passage members at their foremost end part in an enlarged scale.

As illustrated in FIG. 4 in an enlarged scale, each foremost end part of the coin passage members 7, 8 and 9 is tapered in the form of a triangular configuration and has an edge portion 15 formed at its bottom face. Specifically, each of the edge portions 15 of the coin passage members 7, 8 and 9 is fitted into the respective annular grooves 6 in the tangential direction relative to the latter in such a manner that it is located possibly close to the bottom of the annular grooves 6, whereas each upper edge of the foremost end parts of the coin passage members is located flush with the first surface portion 1A.

Further, the coin conveyance means 16 is arranged above the coin passage member 8 located at the middle part of the coin passage 2. In the illustrated embodiment, the coin conveyance means 16 comprises an endless belt 17 which is carried by a rear pulley 18 and a front pulley 20. The rear pulley 18 is rotatably mounted on a shaft 19 extending through the upright standing plate 10 to be operatively connected to a motor $M_1$ whereby it is rotated in the direction as shown by an arrow mark. It should be noted that the shaft 19 is adapted to move up or down with the aid of an adjustment mechanism which is not shown in the drawing depending on the thickness of the coins C and its vertical position can be adjusted if required.

On the other hand, the front pulley 20 is rotatably carried by means of an L-shaped arm 22 at the fore end of a lower arm portion 22*a* thereof. The L-shaped arm 22 is supported pivotally about a shaft 21 horizontally extending through the plate 10, and a tension spring 23 is disposed between the upper arm portion 22*b* and the plate 10 in such a manner as to urge the pulley 20 toward the coin passage member 8.

As is best seen from FIG. 2, two retaining rollers 26 and 27 rotatably held by the lower arm portions 24*a* and 25*a* of L-shaped arms 24 and 25 having the substantially same configuration as that of the aforesaid L-shaped arm 22 are arranged between both the front and rear pulleys 18 and 20 so as to depress the lower running track of the endless belt 17 and thereby prevent it from becoming floated.

The working width of the coin passage 2 is determined in dependence on the distance between the adjacent ones of the coin passage members 7, 8 and 9. The inside and outside coin passage members 7 and 9 are free from contact with the endless belt 17 and the distance between them is dimensioned substantially equal to the diameter of the smallest coins among various kinds of coins to be handled. Specifically, the last mentioned distance is dimensioned appreciably less than the diameter of the smallest coins to be handled so as to ensure that they pass through the coin passage 2 without dropping. The members 7 and 9 may be movably supported so that the width of the passage can be adjustable, and the member 7 may be fixed to the plate 10 with the member 9 movably supported by the rods 12, 13 and 14. Furthermore, the coin passage may be formed by a single plate.

The coin guiding member 3 is disposed downstream of the coin passage 2 as seen in the direction of rotation of the rotary disc 1 as shown by an arrow mark. As is apparent from FIG. 1, it is constructed in the form of an arcuate plate of which one end part diverges at the inner wall of the guide plate 11 and of which the other end part extends at a certain inclination across the second surface portion 1B until it reaches the position in the proximity of the boundary wall 5. Furthermore, it is firmly held by means of a support member 31 fixedly mounted on the housing 30 of the machine in such a manner that its lower edge is spaced from the upper surface of the second surface portion 1B by a close clearance.

As illustrated by two-dotted lines in FIG. 2, the coin turning means 4 includes a coin scooping edge portion **4*a* and a coin turning edge portion 4*b* extending from the coin scooping edge portion 4*a* in an upward inclination, and the coin scooping edge portion 4*a* is located so as to come in contact with the gently slanting conical surface on the central part of the first surface portion 1A of the rotary disc 1 or is spaced from the aforesaid conical surface by a close distance. It is designed in the form of a plate and its upper end part is bent downward to be fixedly secured to the outer surface of the guide plate 11**.

Figure 7:
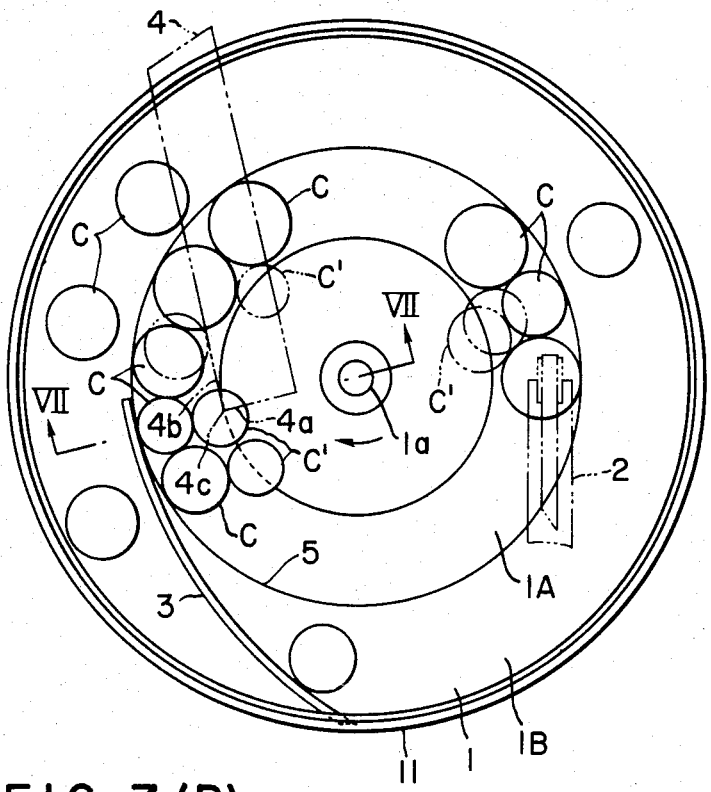
FIG. 7(A) is a schematic plan view of the coin transfer apparatus with a coin guiding means attached thereto, illustrating a principle of operation of the apparatus.
FIG. 7(B) is a partial sectional view of the apparatus, taken along the line VII—VII in FIG. 7(A)
Figure 7:
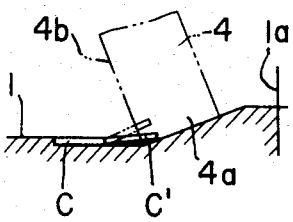

As coins C in a second line are arranged inward of a first line of coins C adapted to move along the boundary wall 5, that is, in the inside area of the rotary disc 1 as seen in the radial direction from the first line of coins C, as illustrated in FIG. 7(A), coins C in the second line are received by means of the coin scooping edge portion **4*a* one after another and then move up along the coin turning edge portion 4*b* as the rotary disc 1 rotates. Since the coin turning edge portion 4*b* extends in an upward inclination, the coins C in the second line are raised up at their edge part on the central side of the disc 1** but they are inhibited from moving up due to the contact with the first line of coins C at their reverse edge parts remote from the center shaft, as illustrated in FIG. 7(B), whereby the former edge parts of the coins C' are increasingly raised up until they are turned over about the latter edge parts thereof which serve as a pivotal center and they are placed on the first line of coins C one by one.

As illustrated in FIG. 2 and 7(A), the position of the intersection **4*c* defined by the coin scooping edge portion 4*a* and the coin turning edge portion 4*b* is spaced from the boundary wall 5 by a distance appreciably longer than the diameter of the biggest coins as measured in the radial direction toward the center shaft 1*a*. It should be noted that there is provided an ample space between the bottom of the coin turning edge portion 4*b* and the upper surface of the first surface portion 1A in order to ensure that the coins placed on the first line of coins C do not collide against the coin turning edge portion 4*b*** when they move below the latter.

The rear end of the coin passage 2 is in operative connection to a coin counting passage, a coin selection passage or the like in dependence on the purpose of its application. Alternatively, the coin passage 2 itself may be equipped with a coin counting mechanism, a coin selection mechanism or the like.

Next, operation of the coin transfer apparatus in accordance with the embodiment as illustrated in the accompanying drawings and described above will be described below.

As the coins C are fed to a working section (as shown by a bigger arrow mark in the drawings) as defined by the coin guiding member 3, the guide plate 11 and the holding plate 31 on the rotary disc 1 with the use of a coin feeding system (not shown in the drawings), they are caused to move outward due to centrifugal force imparted by the rotation of the rotary disc 1.

As the rotary disc 1 continues to rotate, the coin C is brought in abutment against the coin guiding member 3 and it is then introduced from the second surface portion 1B onto the first surface portion 1A until it is located inside of the boundary wall 5. When it leaves the coin guiding member 3, it tends to move outward again due to the centrifugal force.

However, since the coin C abuts against the boundary wall 5 after it is introduced onto the first surface portion 1A, it cannot move to the second surface portion 1B and consequently it is caused to move along the boundary wall 5. If two coins C are placed on the first surface portion 1A one above another, the upper one moves to the second surface portion 1B again under the centrifugal force as illustrated in FIG. 3, because it does not abut against the boundary wall 5 any longer.

As a result the coins C on the first surface portion 1A on the rotary disc 1 are arranged in a single layer without any existence of two or more coins stacked one above another.

As the rotary disc 1 rotates further and the coin C on the first surface portion 1A comes in abutment against the foremost end part of the coin passage 2, it is transferred onto the coin passage 2 via the respective foremost end parts of the coin passage members 7, 8 and 9, as illustrated in FIG. 4. At that time, each coin C is moved smoothly to the foremost end thereof from the first portion 1A because each of edge portions 15 of the members 7, 8 and 9 is fitted into the respective annular grooves 6.

Furthermore, as there is no members for defining the width of the inlet of the coin passage on the left side of the member 9 and the only one side face of the coin passage is defined by the plate 10 while the other side thereof is open toward the center of the disc as seen in FIGS. 2 and 7(A), a coin jamming does not occur at the inlet of the coin passage even when various kinds of coins are handled together. Each coin C is then conveyed rearward on the coin passage members 7, 8 and 9 while it is depressed by the pulley 20 and the lower track of the endless belt 17. When the coins C to be conveyed have a different thickness, any difference in thickness of the coins is compensated by way of turning movement of the arm 22 in the clockwise direction against the resilient force of the coil spring 23. It is obvious that the retaining rollers 26 and 27 and the pulley 19 are displaced in the same manner as the pulley 20.

The coins C held on the second surface portion 1B pass under the coin passage 2 and arrive at the coin guiding member 3 again. They are then introduced onto the first surface portion 1A again in the same manner as mentioned before and they are displaced to the foremost end part of the coin passage 2 while they are arranged in a single line.

When a large number of coins are fed onto the first surface portion, a stacked structure of coins tends to be built thereon but the upper coin is displaced away therefrom onto the second surface portion under centrifugal force as the rotary disc rotates. In addition, it is often found that a second circular line of coin arrangement is formed inward of a first circular line of coin arrangement on the first surface portion. Coins on the first circular line of arrangement are transferred to the coin passage one by one in the ordinary manner. As the rotary disc rotate, they move toward the coin passage as they are. At the moment when the foremost coin on the first circular line of arrangement enters the coin passage, the foremost coin on the second circular line tends to wedge the space formed at the inlet of the passage in the first circular line under the influence of centrifugal force caused by rotation of the rotary disc whereby coin jamming takes place at the inlet part of the coin passage.

However, in this invention, the coin turning means is provided on the first surface portion on the rotary disc in order to displace coins on a second circular line of coin arrangement onto those on a first circular line of coin arrangement by turning over the latter as the rotary disc rotates while the former are brought in abutment against the circular boundary wall whereby such a coin jamming can be avoided.

In the above embodiment, the first and second surface portions are integral with each other, and the second surface portion has a larger radius measured from the center of rotation of the rotary disc than that of the first surface portion. Therefore, the former has a peripheral speed higher than that of the latter.

Due to the arrangement that coins are displaced away from the first surface portion onto the second surface portion under centrifugal force and they are then displaced back onto the first surface portion by means of a coin guiding member as the rotary disc rotates, it is found that the coins moving fast in a spaced relation on the second surface portion moves slowly to be apt to become crowded on the first surface portion when they move back onto the latter.

Figure 6:
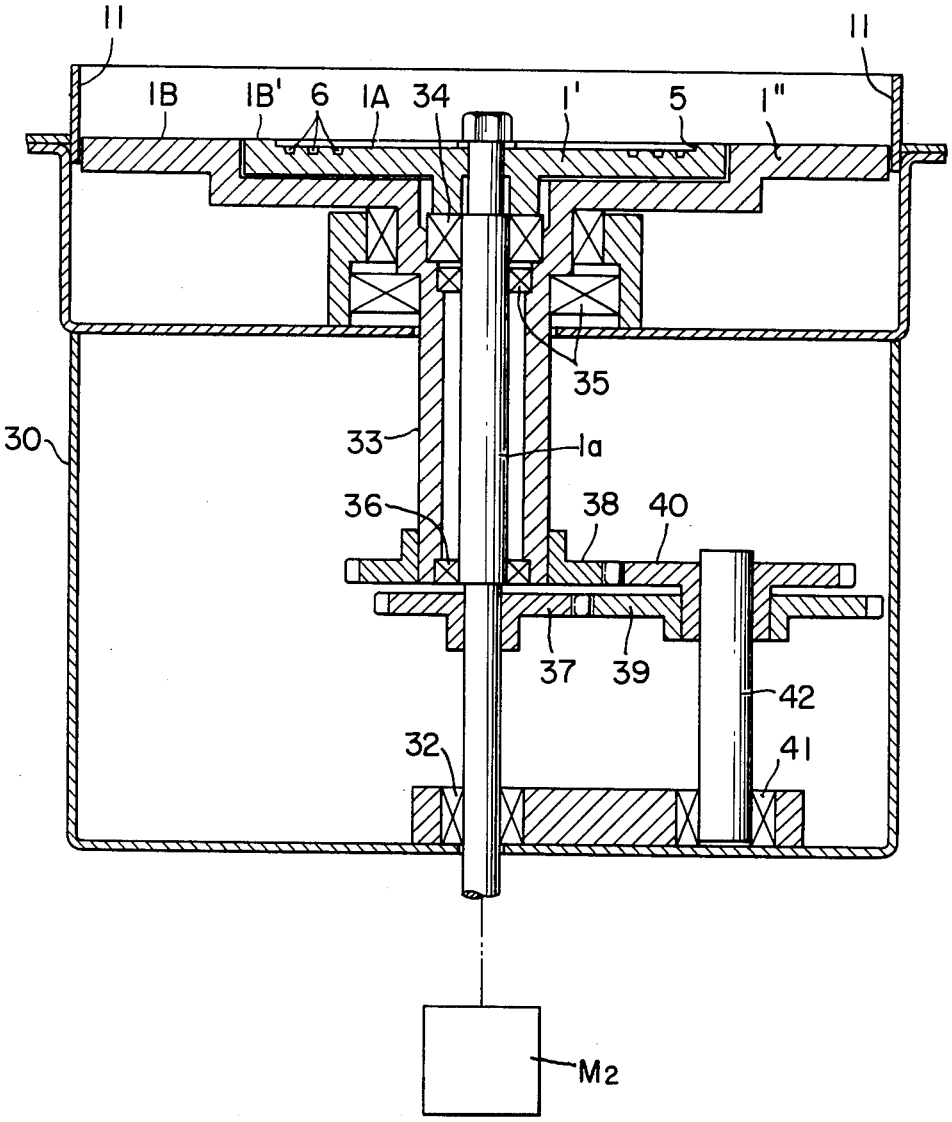
FIG. 6 is a vertical sectional view of the coin transfer apparatus in accordance with another embodiment of the present invention.

FIG. 6 illustrates a modified embodiment for eliminate the above tendency in which the first and second surface portions 1A and 1B are constructed by separate members so as to allow them to be rotated at a different speed.

Specifically, the rotary disc 1 is constructed by a combination of a first rotary disc 1' constituting most of the first surface portion 1A and a second rotary disc 1'' constituting most of the second surface portion 1B.

In the modified embodiment, the boundary wall 5 is provided in the proximity of the periphery of the first rotary disc 1' constituting most of the first surface portion 1A, and the annular area located outward of the boundary wall 5 on the first rotary disc 1' is flush with the second surface portion 1B on the second rotary disc 1'' so that it provides another second surface portion 1B' which constitutes a part of the second surface portion 1B.

The center shaft **1*a* of the first rotary disc 1' is rotatably supported by means of a bearing 32 fixedly mounted on the housing 30 of the machine and a sleeve shaft 33 for the second rotary disc 1'' is fitted onto the center shaft 1*a* in such a manner that it is rotatably supported by means of bearings 34, 35 and 36. The center shaft 1*a* is in operative connection with a motor $M_2$, whereas a gear 37 on the center shaft 1*a* is in operative connection with a gear 38 on the sleeve shaft 33 via a combination of intermediate gears 39 and 40 fixedly mounted on a shaft which is rotatably held by means of a bearing 41 on the housing 30 of the machine. Owing to the arrangement of a group of gears the second rotary disc 1'' is rotated at a speed lower than that of the first rotary disc 1'**.

The structure of the apparatus other than the foregoing is quitely same to that in the first mentioned embodiment and therefore a repeated description will be not required.

Since the first surface portion 1A is rotated at a speed higher than that of the second surface portion 1B in the modified embodiment, there is no fear that the excessive number of coins get together on the first surface portion 1A.

With respect to the structure of the rotary disc 1 various modifications are illustrated in FIGS. 9(A) to (E).

Figure 9:
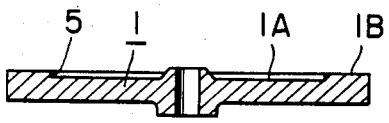
FIGS. 9(A) to (E) are a sectional view of the rotary disc respectively, illustrating typical five examples.
Figure 9:
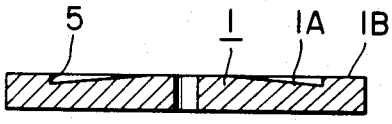
Figure 9:
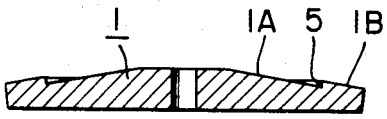
Figure 9:
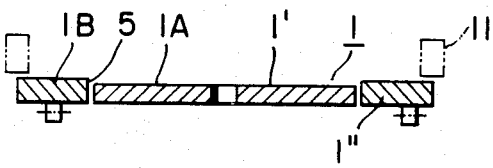
Figure 9:
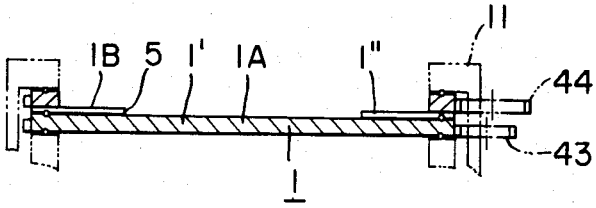

FIG. 9(A) illustrates an example of the fundamental structure of the rotary disc for the apparatus as illustrated in FIG. 1.

FIG. 9(B) illustrates a rotary disc of which first surface portion 1A is designed in a convex configuration having a center of curvature at the center shaft **1*a* so as to ensure smooth movement of the coins C toward the boundary wall 5 on the first surface portion 1A**.

FIG. 9(C) illustrates a rotary disc which has a convex configuration including the second surface portion 1B slanting downwardly toward the outer periphery of the disc so as to prevent the coins C from becoming jammed around the boundary wall 5.

FIG. 9(D) illustrates a modification of the rotary disc 1 in accordance with the modified embodiment of the invention in FIG. 6, wherein there is a height difference between both the first and second rotary discs 1' and 1'' at the boundary wall 5 therebetween so that the boundary wall 5 is formed by a part of the inner peripheral wall of the second rotary disc 1'', and FIG. 9(E) illustrates another combination of both the first rotary disc 1' and the second rotary disc 1'', wherein the second rotary disc 1'' is designed in an annular configuration in such a manner as to be placed on the peripheral part of the first rotary disc 1' and thereby form the boundary wall 5 along the inner wall thereof and both the first and second rotary discs 1' and 1'' are rotated via gears 41 and 42 so as to ensure operative connection therebetween.

Figure 8:
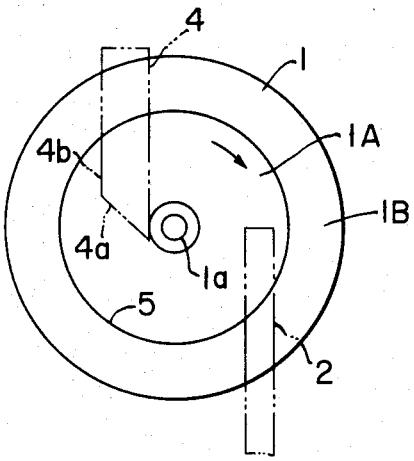
FIG. 8(A) is a schematical plan view of the apparatus with a modified coin guiding means attached thereto.
FIG. 8(B) is a side view of the coin guiding means on the rotary disc in FIG. 8(A)
Figure 8:
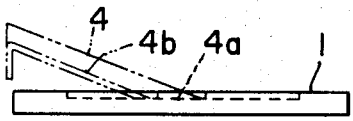

It should be noted that in such a case as illustrated in FIGS. 9(A) and (E) where the rotary disc 1 does not include any conical raised portion as illustrated in FIG. 2, the coin turning means 4 should be preferably designed in such a manner as illustrated in FIGS. 8(A) and (B). Specifically, the coin turning means 4 is designed such that the inner side of the coin scooping edge portion **4*a* comes in contact with the boss of the rotary disc 1 through which the center shaft 1*a* extends in the vertical direction and the front side of the same extends obliquely downstream relative to the flow of the coins. Further, it is more preferable that the coin scooping edge portion 4*a* is designed in a serrated configuration at the foremost end while the first surface portion 1A on the rotary disc 1 is formed with a plurality of annular grooves corresponding to the serrated configuration of the coin scooping edge portion 4*a* so that the respective serrations are fitted into the corresponding annular grooves. On the other hand, it is the minimum requirement for the coin turning edge portion 4b of the coin turning means 4 that it extends at least by the distance between the coin scooping edge portion 4a** and the upper surface of the coins arranged in the first circular line.

In the embodiments as shown in FIGS. 9(D) and 9(E), both the rotary members 1' and 1'' rotate at a different speed and thereby there occurs a difference in peripheral speed at the circular boundary wall. Therefore, coins to be transferred are caused to rotate on the first surface portion while their peripheral edge parts come in contact against the circular boundary wall. As a result each of the coins wears at the bottom as well as at the peripheral edge part and moreover they fail to enter the coin passage smoothly because of their rotational movement. However, if the circular boundary wall is formed on the first rotary member 1' in the vicinity of the outer periphery thereof as shown in FIG. 6, there is no fear of causing wear on the coins due to their rotational movement and difficulty in entering the coin passage.

The present invention has been described above with respect to the preferred embodiments as illustrated in the accompanying drawings, but it should be of course understood that it should be not limited only within them and various changes or modifications may be made in a suitable manner without any departure from the spirit and scope of the invention.

For instance, in such a case that a reduced number of coins are fed onto the first surface portion, it is advisable that the coin turning means 4 is removed.

With respect to the coin passage 2 many variations from the illustrated structure may be made and any suitable one is acceptable, as long as it is designed so as to receive coins C from the first surface portion 1A. Further, with respect to the coin guiding member 3 and the coin turning means 4 the same thing is applicable to them.

What is claimed is:

1. A coin transfer apparatus for transferring or feeding coins one by one to a coin counting process, a coin selecting process or the like under centrifugal force, said apparatus comprising:

a rotary disc including a first surface portion defined within a circular area having a predetermined radius measured from the center of rotation thereof in which coins fed from the outside thereonto are adapted to move outward in the radial direction under centrifugal force caused by the rotation of the rotary disc, a circular boundary wall defining the outer periphery of said first surface portion, said circular boundary wall having a height less than the thickness of coins to be transferred, and a second surface portion extending outward of the circular boundary wall in the radial direction so as to slide the coins thereon;

a coin passage adapted to receive the coins carried on the first surface portion and then convey them to the next process or the like while the coins are positionally defined by means of the circular boundary wall during the movement on the first surface portion; and a coin guiding member extending from the outer periphery of the rotary disc to the circular boundary wall or the position in the proximity of the latter so as to urge the coins displaced away from the first surface portion beyond the circular boundary wall onto the second surface portion to move back again onto the first surface portion.

2. A coin transfer apparatus according to claim 1, wherein the rotary disc has a conical raised portion in the central area of the disc where the first surface is formed.

3. A coin transfer apparatus according to claim 2, wherein the second surface slants downwardly toward the outer periphery of the rotary disc.

4. A coin transfer apparatus according to claim 1, wherein said first surface portion is provided with at least one annular groove in the proximity of the outer periphery thereof, said coin passage having at least one coin passage member of which foremost end part is adapted to be fitted into the annular groove in the substantially tangential direction relative to the groove, said coin passage member extending from the first surface portion beyond the outer wall of the rotary disc in an upward inclination while at least one of the side faces of the coin passage on the inner side of the disc is open so that coins of various diameters can pass on the coin passage member, said coin passage also having a coin conveyance means disposed on the coin passage so as to convey the coins in cooperation with the coin passage member.

5. A coin transfer apparatus according to claim 4, wherein said coin passage having a plurality of coin passage members, the distance between adjoining members being adjustable in dependence on the diameter of coins to be handled.

6. A coin transfer apparatus according to claim 4, wherein said coin conveyance means is formed in the shape of a belt conveyor having an endless belt, a pair of pulleys located at two ends of the belt and at least one retaining roller, said pulleys and retaining roller being supported by means of pivotal arms so that their positions are adjustable in dependence on the thickness of coins to be transferred.

7. A coin transfer apparatus according to claim 1, wherein said rotary disc has a first rotary member forming a central portion thereof and a second rotary member rotating along the periphery of the first rotary member, said first and second rotary members being rotated separately so that the first member rotates at a speed higher than that of the second rotary member, said circular boundary wall being formed on the first or second rotary member or between them.

8. A coin transfer apparatus according to claim 7, wherein said circular boundary wall being formed on the first rotary member in the proximity of the outer periphery thereof.

9. A coin transfer apparatus according to claim 7, wherein said circular boundary wall being formed between the first and second rotary members at the adjoining point thereof, the upper surface of the second rotary member being higher than that of the first rotary member.

10. A coin transfer apparatus according to claim 1, wherein said rotary disc has a first rotary member and a second rotary member rotatably mounted on the first rotary member at its outer periphery in an overlapped relation so that the circular boundary wall is formed at the inner periphery of the second rotary member.

11. A coin transfer apparatus according to claim 1, wherein a coin turning means is provided over the first surface portion so as to displace coins located in a second circular line of coins which is formed inside of a first line of coins which is formed along the circular boundary wall onto the coins located in the first line by turning over the coins.

12. A coin transfer apparatus according to claim 11, wherein the coin turning means is constructed in the form of an elongated plate extending from the first surface portion to the outer wall of the rotary disc in an upward inclination, said elongated plate including a coin scooping edge portion formed in the lower part thereof and a coin turning edge portion formed on the outer side thereof with respect to the center of the disc.

13. A coin transfer apparatus according to claim 12, wherein said coin scooping edge portion is formed so as to extend obliquely downstream, relative to the flow of the coins, from the central portion of the disc.

* * * * *